US007134852B1

(12) United States Patent
Lai

(10) Patent No.: US 7,134,852 B1
(45) Date of Patent: Nov. 14, 2006

(54) SEAL MEMBER FOR VORTEX COMPRESSOR

(75) Inventor: Chin-Liang Lai, Pingtung (TW)

(73) Assignee: Heng Sheng Precision Tech. Co., Ltd., Taoyuan County (TW)

( * ) Notice: Subject to any disclaimer, the term of this patent is extended or adjusted under 35 U.S.C. 154(b) by 0 days.

(21) Appl. No.: 11/333,369

(22) Filed: Jan. 18, 2006

(51) Int. Cl.
*F03C 2/00* (2006.01)
*F04C 18/00* (2006.01)

(52) U.S. Cl. ..... 418/55.4; 418/55.1; 418/55.6; 418/142

(58) Field of Classification Search ..... 418/55.1–55.6, 418/57, 142
See application file for complete search history.

(56) References Cited

U.S. PATENT DOCUMENTS 4,869,658 A * 9/1989 Tsutsumi et al. ..... 418/55.4

FOREIGN PATENT DOCUMENTS

JP 01121582 A * 5/1989 ..... 418/55.4
JP 03011101 A * 1/1991 ..... 418/55.4
JP 03246389 A * 11/1991 ..... 418/55.4
JP 06272679 A * 9/1994 ..... 418/55.4
JP 2002031069 A * 1/2002 ..... 418/55.4

* cited by examiner

*Primary Examiner*—Theresa Trieu
(74) *Attorney, Agent, or Firm*—Rosenberg, Klein & Lee

(57) ABSTRACT

A vortex compressor includes a stationary vortex body and a rotatable vortex body located in the casing so as to define a compression chamber and an expelling chamber. Each of the stationary vortex body and the rotatable vortex body has a base board and a vortex portion extending from the base board. A vortex groove is defined in an end surface of each of the vortex portion and a seal member is engaged with the vortex groove. The vortex groove includes a start end which is located close to the base board. Each of the seal members includes a cut-off portion defined in a distal end thereof in the start end. When the compressor is activated, the refrigerant enters the grooves to push the seal members toward the vortex boards to maintain the pressure.

2 Claims, 8 Drawing Sheets

SEAL MEMBER FOR VORTEX COMPRESSOR

FIELD OF THE INVENTION

The present invention relates to a seal member installed in the end surface of each of the stationary vortex body and rotatable vortex body.

BACKGROUND OF THE INVENTION

A conventional vortex compressor includes a casing in which a compression chamber and an expelling chamber are defined and separated by a stationary vortex body. The refrigerant is introduced into the compression chamber via an inlet and the rotatable vortex body is rotated relative to the stationary vortex body to compress the refrigerant. During compression, the pressure between the base board and vortex surface of the stationary vortex body and the rotatable vortex body suddenly increases such that leakage might happen in axial direction. The leakage is worse when the vortex surface is worn out. This results in less efficiency for the refrigerant in the whole air-conditioning system.

As shown in FIG. 8, a vortex groove 81 is defined in the end surface 8 of the stationary and rotatable vortex bodies and a seal member 9 is engaged with the groove 81 so as to improved the leakage described in the above-mentioned air-conditioning system.

The present invention intends to provide a seal member which includes a stepped surface defined in the first end thereof so that when the compressor is activated, the refrigerant enters the gap between the seals and the grooves to push the seal members toward the vortex boards so that the pressure is maintained. By this way, the efficiency for the compressor can be increased.

SUMMARY OF THE INVENTION

The present invention relates to a vortex compressor which comprises a casing in which a stationary vortex body and a rotatable vortex body are located so as to define a compression chamber and an expelling chamber with the stationary vortex body located between the two chambers. The stationary vortex body and the rotatable vortex body are located in the compression chamber. Each of the stationary vortex body and the rotatable vortex body has a base board and a vortex portion extends from the base board. A vortex groove is defined in an end surface of each of the vortex portion and a seal member is engaged with the vortex groove. The vortex groove includes a start end which is located close to the base board. Each of the seal members includes a cut-off portion defined in a distal end thereof and located close to the start end of the vortex groove. The cut-off portion faces an inside of the vortex groove. The refrigerant enters the gap between the cut-off portion of the seals and the grooves to push the seal members toward the vortex boards when the compressor is activated.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
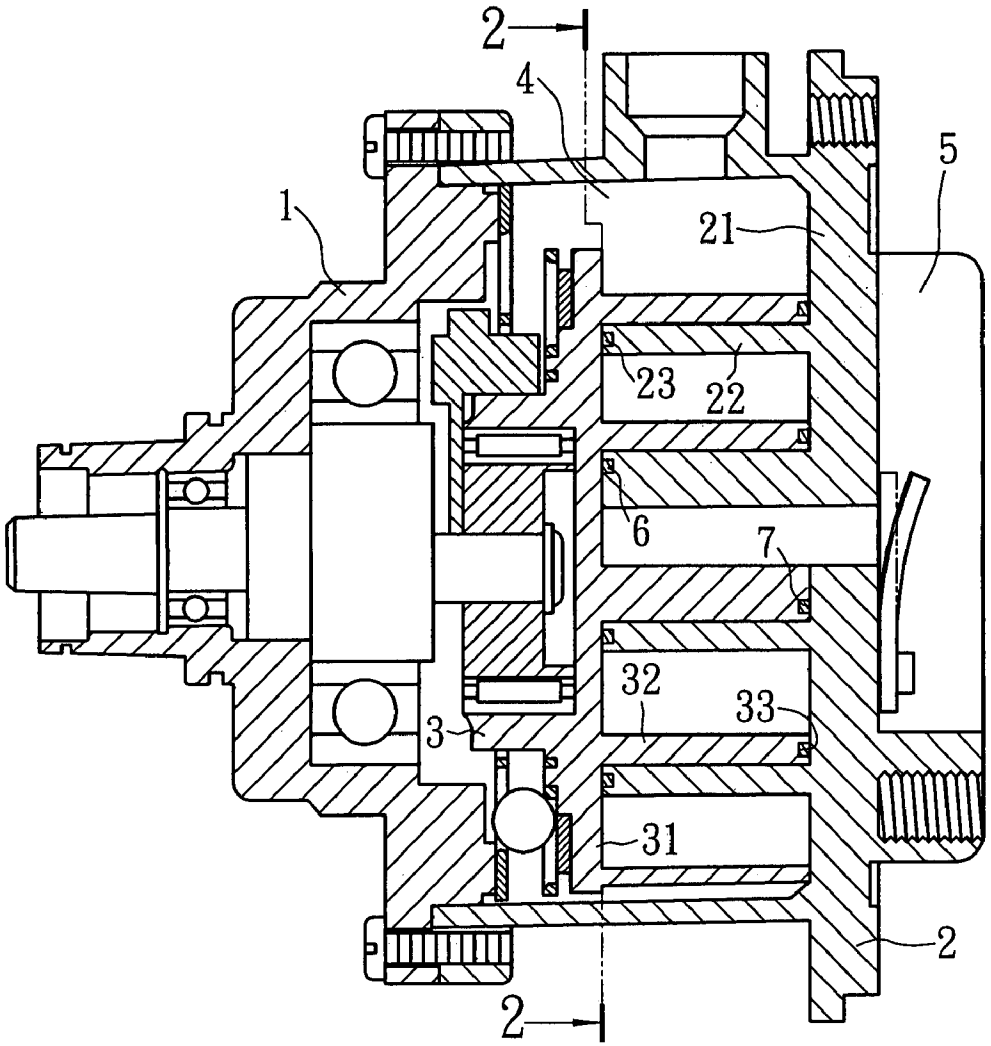
FIG. 1 is a cross sectional view of the compressor.
Figure 2:
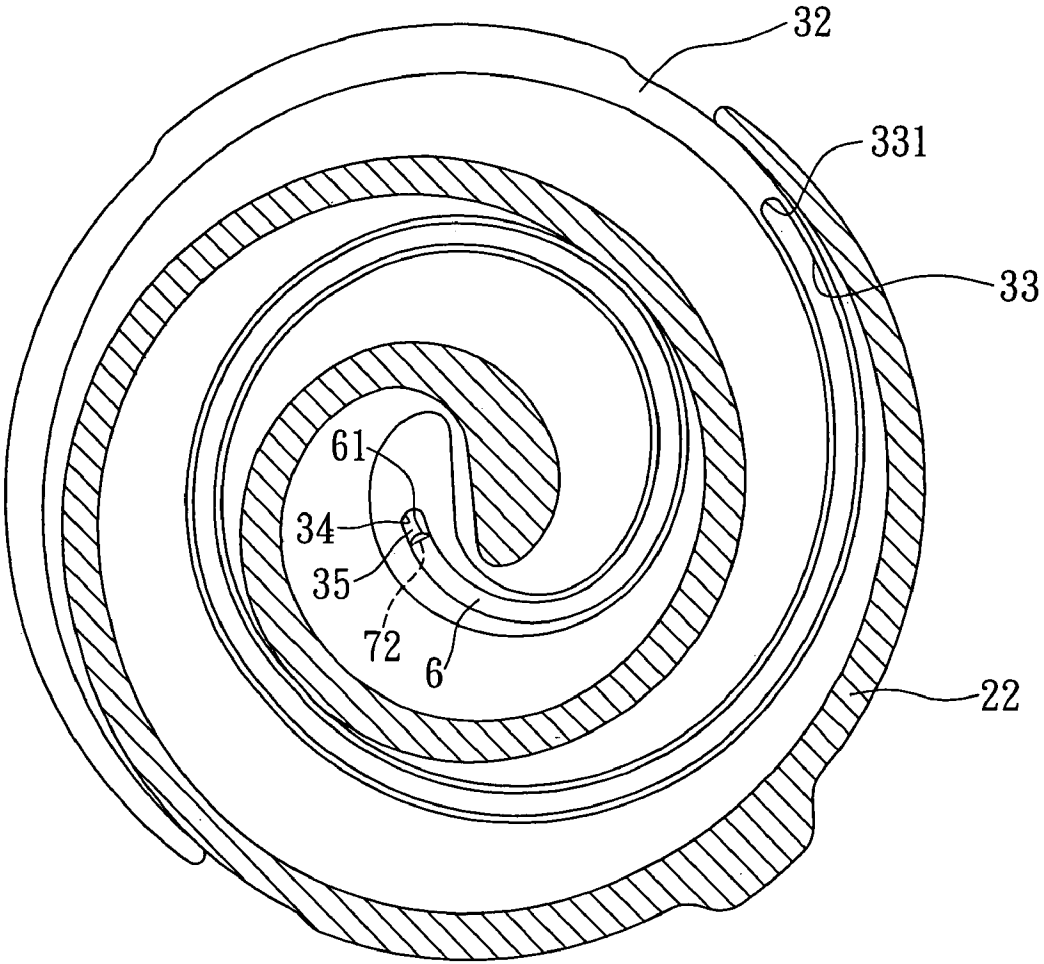
FIG. 2 is a cross sectional view along line 2—2 in FIG. 1.

Referring to FIGS. 1 to 5, the vortex compressor of the present invention comprises a casing 1 in which a stationary vortex body 2 and a rotatable vortex body 3 are located. The rotatable vortex body 3 is rotatable relative to the stationary vortex body 2. A compression chamber 4 and an expelling chamber 5 are defined in the casing 1 and separated by the stationary vortex body 2. The stationary vortex body 2 and the rotatable vortex body 3 are located in the compression chamber 4.

Each of the stationary vortex body 2 and the rotatable vortex body 3 has a base board 21/31 and a vortex portion 22/32 extends from the base board 21/31. A vortex groove 23/33 is defined in an end surface of each of the vortex portion 22/32. A seal member 6/7 is engaged with the vortex groove 23/33.

Figure 3:
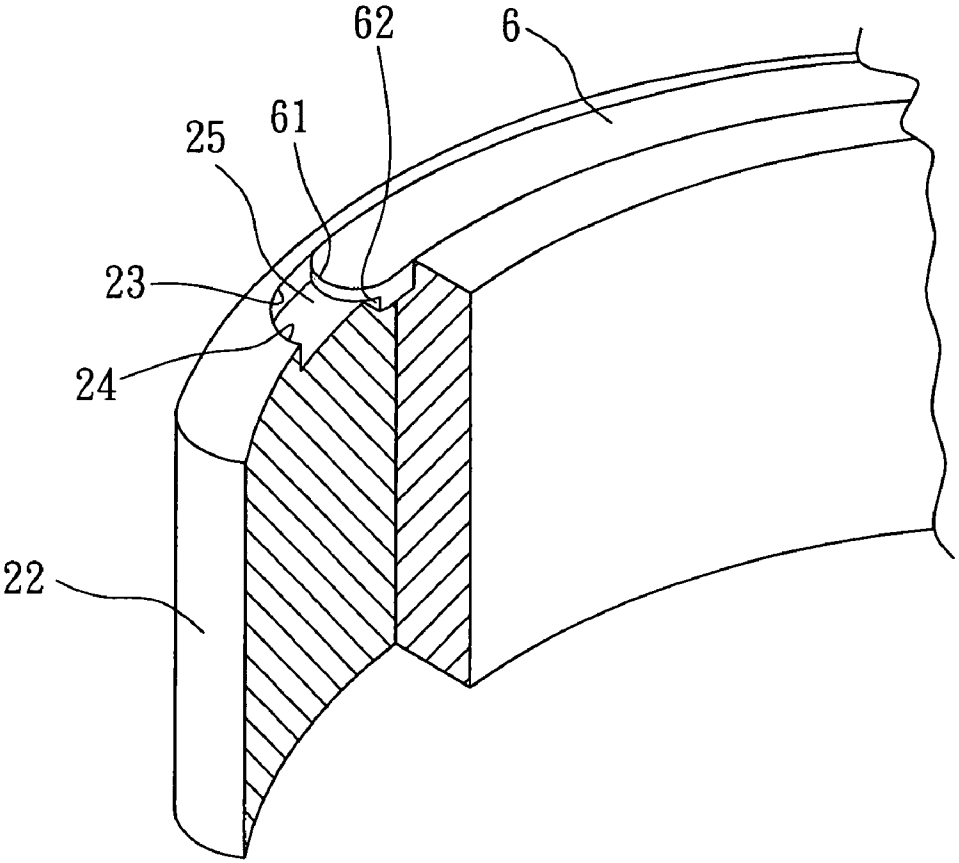
FIG. 3 shows the seal member engaged with the vortex groove.
Figure 4:
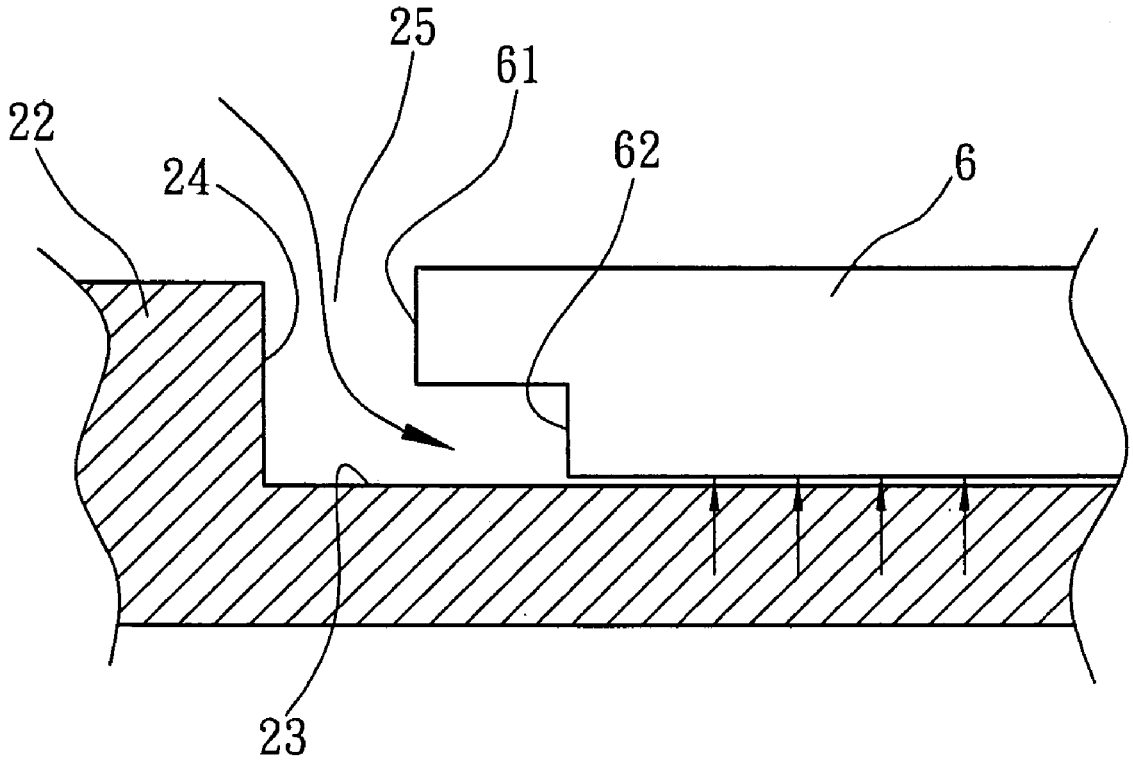
FIG. 4 shows refrigerant enters the gap between the seal member and the inside of the vortex groove.
Figure 5:
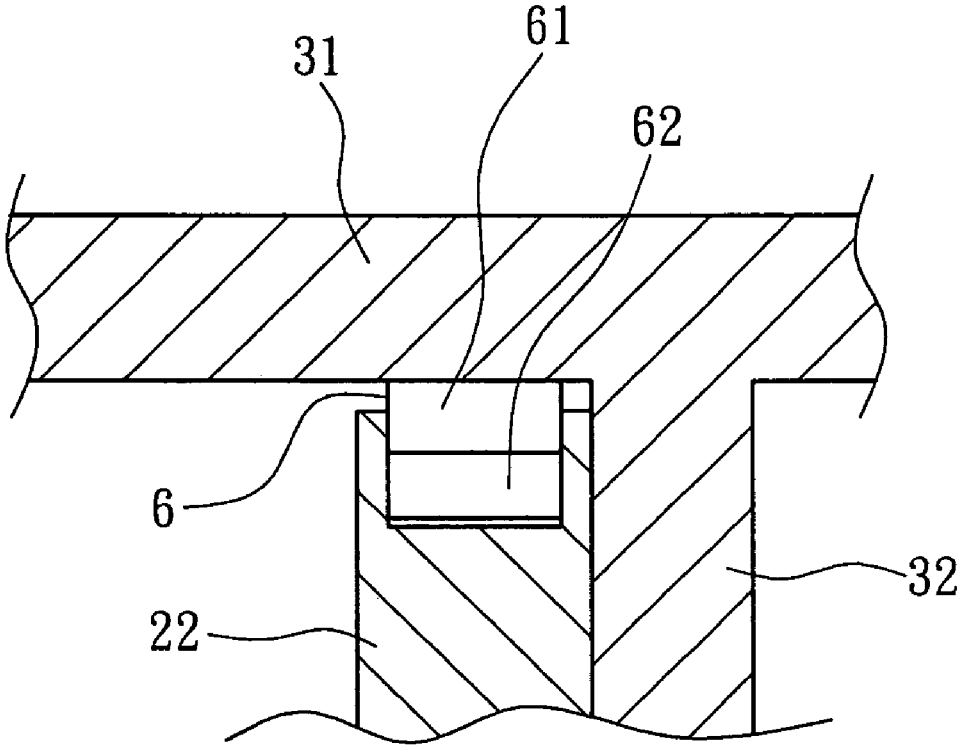
FIG. 5 shows the base board, the vortex portion, and the seal member engaged with the vortex groove.

The vortex groove 23/33 includes a start end 24/34 which is located close to the base board 21/31. Each of the seal members 6/7 includes a cut-off portion defined in a distal end 61/71 thereof which is located close to the start end 24/34 of the vortex groove 23/33. A gap 25/35 is defined between the distal end 61/71 of the seal member 6/7 and the start end 24/34 of the vortex groove 23/33 as shown in FIGS. 3 and 4 and a stepped surface 62/72 is defined in the cut-off portion and faces an inside of the vortex groove 23/33.

When the compressor is activated, the refrigerant enters into the start end 24/34 of the vortex groove 23/33 due to higher pressure and applies a force to the stepped surface 62/72, the distal end 61/71 of the seal member 6/7 is then lifted upward slightly and the refrigerant then enters the gap between the seal member 6/7 and the inside of the vortex groove 23/33 till the final end 231/331 of the vortex groove 23/33. The seal member 6/7 is pushed by the refrigerant to contact against the base board 21/31 so as to effectively seal the base board 21/31 and the vortex portion 22/32. By this way, the compression ratio can be maintained and even if the seal member 6/7 is slightly worn out, the seal member 6/7 still seals the gap by the refrigerant.

Figure 6:
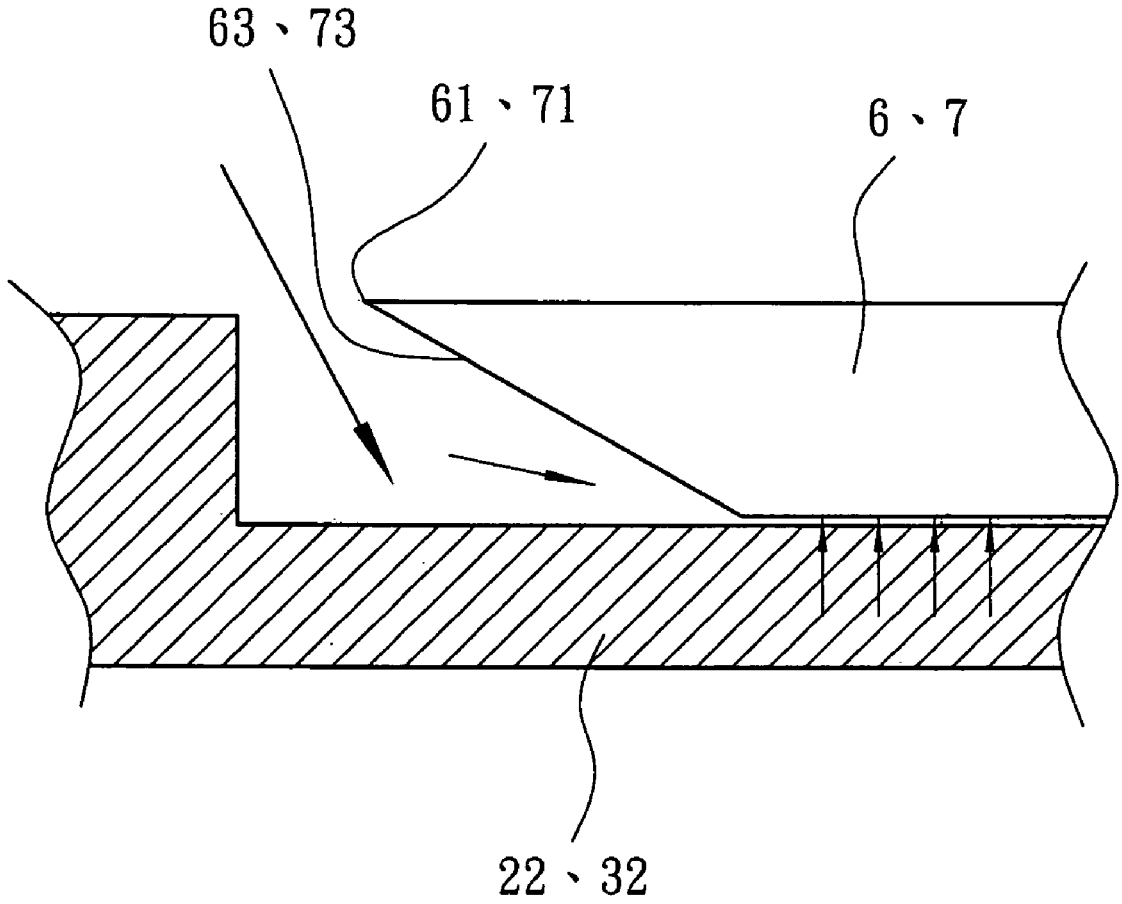
FIG. 6 shows a second embodiment of the seal member.

As shown in FIG. 6 which discloses a second embodiment of the seal member 6/7 wherein the cut-off portion is an inclined surface 63/73. When the compressor is activated, the refrigerant enters into the start end 24/34 of the vortex groove 23/33 due to higher pressure and applies a force to the inclined surface 63/73, the distal end 61/721 of the seal member 6/7 is then lifted upward slightly and the refrigerant then enters the gap between the seal member 6/7 and the inside of the vortex groove 23/33 till the final end 231/331 of the vortex groove 23/33. The seal member 6/7 is pushed by the refrigerant to contact against the base board 21/31 so as to effectively seal the base board 21/31 and the vortex portion 22/32.

Figure 7:
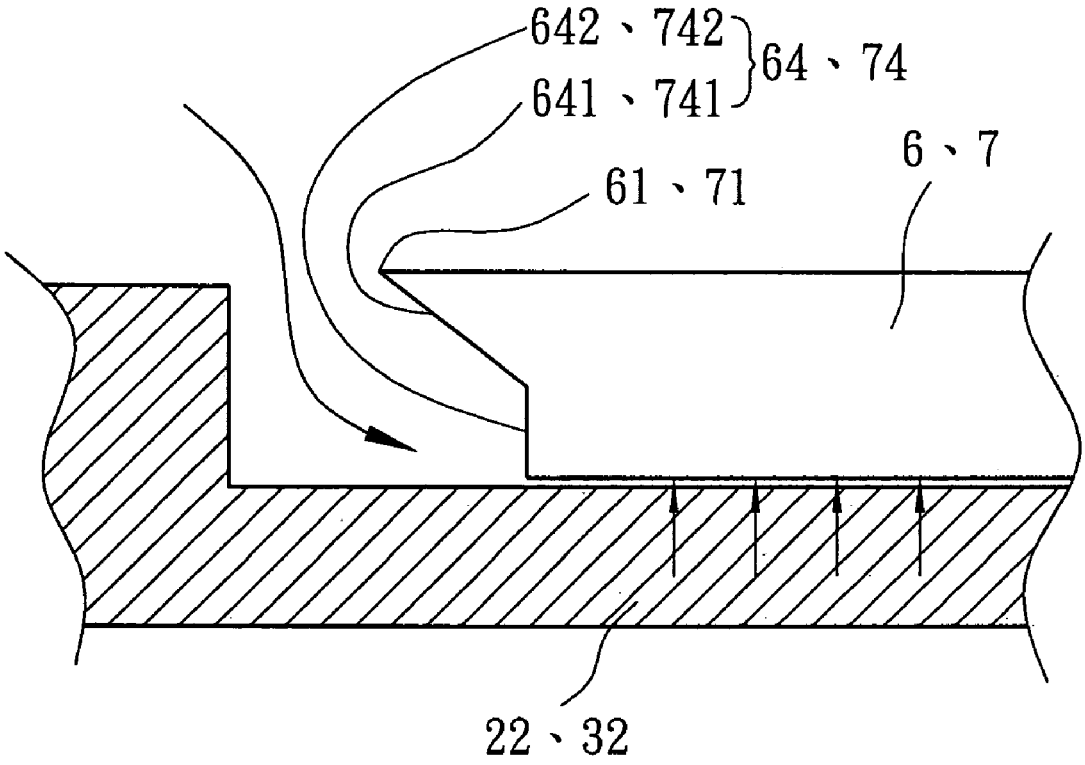
FIG. 7 shows a third embodiment of the seal member.
Figure 8:
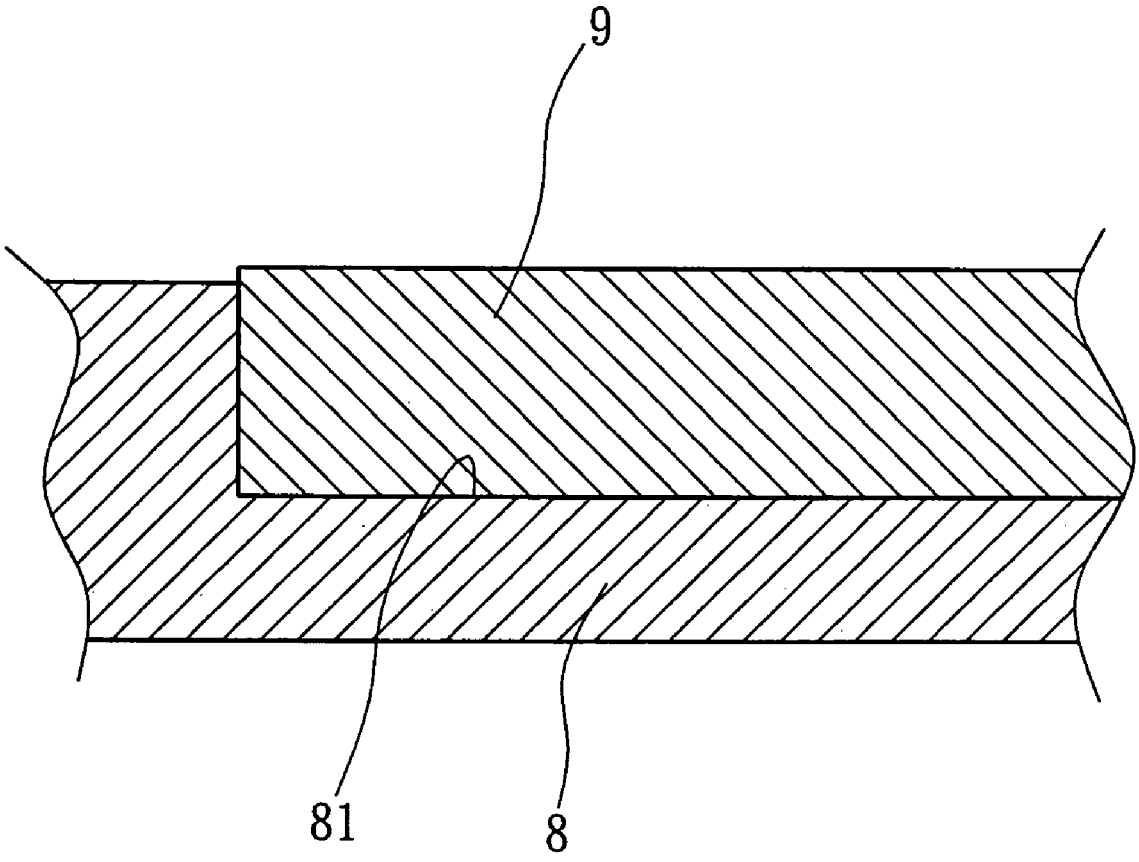
FIG. 8 PRIOR ART
FIG. 8 is a conventional seal member and the vortex groove of the vortex body.

FIG. 7 shows a third embodiment of the seal member wherein the cut-off portion is an inclined a combination surface 64/74 which is composed of an inclined section

641/741 and a vertical section 642/742. When the compressor is activated, the refrigerant enters into the start end 24/34 of the vortex groove 23/33 due to higher pressure and applies a force to the combination surface 64/74, the distal end 61/71 of the seal member 6/7 is then lifted upward slightly and the refrigerant then enters the gap between the seal member 6/7 and the inside of the vortex groove 23/33 till the final end 231/331 of the vortex groove 23/33. The seal member 6/7 is pushed by the refrigerant to contact against the base board 21/31 so as to effectively seal the base board 21/31 and the vortex portion 22/32.

While we have shown and described the embodiment in accordance with the present invention, it should be clear to those skilled in the art that further embodiments may be made without departing from the scope of the present invention.

What is claimed is:

1. A vortex compressor comprising:

a casing;

a stationary vortex body and a rotatable vortex body located in the casing, the rotatable vortex body being rotatable relative to the stationary vortex body, a compression chamber and an expelling chamber being defined in the casing and separated by the stationary vortex body, the stationary vortex body and the rotatable vortex body being located in the compression chamber, and the stationary vortex body and the rotatable vortex body each having a base board and a vortex portion extending from the corresponding base board, a vortex groove being defined in an end surface of each of the vortex portions of the stationary vortex body and the rotatable vortex body, a pair of seal members respectively engaged within the vortex grooves of the stationary vortex body and the rotatable vortex body, each vortex groove including a start end which is located close to the corresponding base board, each of the seal members including a cut-off portion defined in a distal end thereof and located close to the start end of the respective vortex groove, the cut-off portion facing an inside of the respective vortex groove, the cut-off portion being a combination surface which is composed of an inclined section and a vertical section.

2. The compressor as claimed in claim 1, wherein a gap is defined between the distal end of the seal member and the start end of the vortex groove.

* * * * *